US007655877B2

(12) United States Patent
Ahn

(10) Patent No.: US 7,655,877 B2
(45) Date of Patent: Feb. 2, 2010

(54) AIR CIRCUIT BREAKER WITH MECHANICAL TRIP INDICATING MECHANISM

(75) Inventor: Kil-Young Ahn, Daejeon (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 86 days.

(21) Appl. No.: 12/164,296

(22) Filed: Jun. 30, 2008

(65) Prior Publication Data

US 2009/0015357 A1 Jan. 15, 2009

(30) Foreign Application Priority Data

Jul. 12, 2007 (KR) ..... 10-2007-0070272

(51) Int. Cl.
*H01H 5/00* (2006.01)
*H01H 73/12* (2006.01)
*H01H 9/00* (2006.01)

(52) U.S. Cl. ..... 200/400; 200/308; 200/337; 200/341; 200/345; 335/17

(58) Field of Classification Search ..... 200/308–345, 200/400, 401; 335/17
See application file for complete search history.

(56) References Cited

U.S. PATENT DOCUMENTS 5,605,224 A * 2/1997 Seymour et al. ..... 200/401
5,714,940 A * 2/1998 Fishovitz et al. ..... 340/638
5,945,648 A * 8/1999 M'Sadoques ..... 200/43.14
5,973,278 A * 10/1999 Wehrli et al. ..... 200/308
5,981,887 A * 11/1999 Robarge et al. ..... 200/308
6,005,208 A * 12/1999 Castonguay ..... 200/308
6,080,947 A * 6/2000 Ulerich et al. ..... 200/308

(Continued)

FOREIGN PATENT DOCUMENTS

EP 1274109 1/2003

(Continued)

OTHER PUBLICATIONS

English language Abstract of EP 1274109, Jan. 8, 2003.

(Continued)

*Primary Examiner*—Ramon M Barrera
(74) *Attorney, Agent, or Firm*—Greenblum & Bernstein, P.L.C.

(57) ABSTRACT

An air circuit breaker having a mechanical trip indicating mechanism, in an air circuit breaker including a switching mechanism, an actuator having an output link for providing a mechanical driving force, a first link unit connected between the output link of the actuator and the switching mechanism for applying the mechanical driving force from the output link to the switching mechanism to perform a trip operation, a front surface plate provided with a manipulating unit accessible by a user, the air circuit breaker comprising: a first rotation lever connected to the first link unit, a second link unit limitedly moved by the first rotation lever, a bias spring for applying an elastic biasing force to the second link unit to be moved in one direction, a second rotation lever installed to be rotatable with coming in contact with one end portion of the second link unit, and a mechanical trip indicating mechanism supported by the front surface plate and having an indicating portion exposed to the front surface plate to indicate the tripped state of the air circuit breaker and a driving force receiving portion contacted with the second rotation lever to receive a driving force from the second rotation lever to expose the indicating portion.

10 Claims, 10 Drawing Sheets

U.S. PATENT DOCUMENTS

| | | | | |
|---|---|---|---|---|
| 6,130,390 | A * | 10/2000 | Castonguay | 200/308 |
| 2002/0056619 | A1 | 5/2002 | Dahl et al. | |
| 2002/0158724 | A1 | 10/2002 | Wellner et al. | |
| 2008/0087534 | A1 | 4/2008 | Yang et al. | |
| 2008/0088395 | A1 | 4/2008 | Seo | |
| 2008/0088396 | A1 | 4/2008 | Ahn et al. | |
| 2008/0122563 | A1 | 5/2008 | Song | |
| 2008/0157906 | A1 | 7/2008 | Oh | |

FOREIGN PATENT DOCUMENTS

| | | |
|---|---|---|
| RU | 2136074 | 8/1999 |

OTHER PUBLICATIONS

English language Abstract of RU 2136074, Aug. 27, 1999.

U.S. Appl. No. 12/144,793 to Lyu, which was filed on Jun. 24, 2008.

U.S. Appl. No. 12/146,702 to Park, which was filed on Jun. 26, 2008.

U.S. Appl. No. 12/147,698 to Yang, which was filed on Jun. 27, 2008.

U.S. Appl. No. 12/163,002 to Sohn, which was filed on Jun. 27, 2008.

U.S. Appl. No. 12/164,691 to Ahn, which was filed on Jun. 30, 2008.

U.S. Appl. No. 12/165,789 to Kim et al., which was filed on Jul. 1, 2008.

* cited by examiner

AIR CIRCUIT BREAKER WITH MECHANICAL TRIP INDICATING MECHANISM

RELATED APPLICATION

The present disclosure relates to subject matter contained in priority Korean Application No. 10-2007-0070272, filed on Jul. 12, 2007, which is herein expressly incorporated by reference in its entirety.

BACKGROUND OF THE INVENTION

1. Field of the Invention

The present invention relates to an air circuit breaker, and particularly, to an air circuit breaker having a mechanical trip indicating mechanism capable of mechanically reliably indicating a user of a trip operation of the air circuit breaker having done when an overcurrent trip relay sensed a fault current on a circuit.

2. Background of the Invention

In general, an air circuit breaker includes as a controlling unit an overcurrent trip relay (OCR) which senses a fault current on a circuit and then generates and outputs a control signal to allow a trip operation (i.e., automatic circuit breaking) of the air circuit breaker upon the occurrence of such fault current. The air circuit breaker also includes a switching mechanism connected to a movable contactor to drive the movable contactor to switch the circuit to close or open, and an actuator (configured as a solenoid coil actuator, for example) connected to the switching mechanism such that upon receiving a control signal from the overcurrent trip relay, the actuator mechanically transfers the control signal to the switching mechanism to thusly be tripped. Here, since the overcurrent trip relay is implemented as an electronic control circuit, it can store information as to that the control signal is outputted by itself or display (indicate) such information on a display or the like. However, the trip indicating function of the overcurrent trip relay merely denotes that the control signal was outputted for the trip operation. For example, if the actuator has received the control signal but failed to mechanically transfer the control signal to the switching mechanism, the trip indication becomes false. Accordingly, reliability may not be ensured for the electronic trip indicating function of the overcurrent trip relay. Thus, an air circuit breaker having such mechanical trip indicating mechanism according to the present invention is required.

Now, the configuration and operational effect of an air circuit breaker according to one example of the related art will be described with reference to the accompanying drawing.

FIG. 1 is a perspective view showing an overall outer appearance of an air circuit breaker according to the related art. As shown in FIG. 1, an air circuit breaker 1 according to the related art includes a main cover 2 disposed at a front face as a portion serving as an interfacing for as a user manipulation or the like. An overcurrent trip relay 3 is disposed at one side on the main cover 2, and an auxiliary cover 4 for particularly covering the overcurrent trip relay 3 is disposed with being supported on the main cover 2. Manual manipulation buttons for manually switching on or off the air circuit breaker 1 are disposed at a portion of the main cover 2 adjacent to the auxiliary cover 4. Such buttons includes a switch-off button 6 for manually breaking (switching off) the air circuit breaker 1, and a switch-on button 5 for manually closing (conducting) the air circuit breaker 1.

FIG. 2 is a perspective view showing a connection relation among an actuator, a driving force transmitting unit and a switching mechanism all for a trip operation in a state of the front main cover being removed from the air circuit breaker according to the related art. An internal configuration of the related art air circuit breaker will now be described with reference to FIG. 2.

Inside the air circuit breaker having the main cover removed, an actuator 20 adjacent to the main cover 2 (see FIG. 1) is disposed at a rear side of the overcurrent trip relay 3 (see FIG. 1), and an output link 21 corresponding to an output unit of the actuator 20 protrudes through an opening of the side face of the actuator 20 and is vertically movable so as to transfer a mechanical trigger signal. Also, a first link unit 23 is disposed at a side surface of the actuator 20 such that it contacts the vertically lowered output link 21 so as to transfer the vertical driving force to an off shaft 36 of a switching mechanism 30 via a protrusion 22 of the first link unit 23. The switching mechanism 30 is disposed at a rear side of the main cover 2 to be adjacent to the actuator 20. Accordingly, when the off shaft 36 is pressed by the protrusion 22 of the first link unit 23, the switching mechanism 30, in response, applies a driving force to separate a movable contactor from a stationary contactor for tripping a circuit. An unexplained reference numeral 1*a* in FIG. 2 denotes an insulation molding portion for supporting movable contactors for each phase and corresponding stationary contactors to be electrically insulated by each phase.

FIG. 3 is a perspective view showing the configuration of the actuator and the driving force transmitting unit of the air circuit breaker according to the related art. As shown in FIG. 3, in order for the output link 21 of the actuator 20 to mechanically transfer a trigger signal via the opening at the side surface of the actuator 20, namely, to trigger the switching mechanism 30 to perform the trip operation, the output link 21 protrudes to be vertically movable.

The first link unit 23 is contacted and pressed by the output link 21 which moves in a vertical direction, specifically, moves downwardly in the vertical direction when transferring a mechanical trigger signal, thus to be vertically moved. Accordingly, the off shaft 36 (see FIG. 2) of the switching mechanism 30 is pressed by the first link unit 23 to be then rotated.

Description will be given of the switching mechanism of the air circuit breaker according to the related art and a switching operation of the contact point between a movable contactor connected to the switching mechanism and the corresponding stationary contactor, with reference to FIGS. 4 to 6. Here, although an air circuit breaker according to the present invention is related to a mechanical trip indicating mechanism other than the switching mechanism and the contactors, such switching operation of the contactors can be recited for the understanding of the configuration and operation of the corresponding parts in the air circuit breaker according to the present invention. So the description is introduced herein.

FIG. 4 is a state view showing the operation among a switching mechanism, a movable contactor connected to the switching mechanism, and a stationary contactor in an air circuit breaker according to the related art, which shows an operational state where the air circuit breaker is broken (tripped, blocked) and a closing spring is charged. FIG. 5 is a state view showing the operation among the switching mechanism, the movable contactor connected to the switching mechanism, and the stationary contactor in the air circuit breaker according to the related art, which shows an operational state where the air circuit breaker is closed (conducted) and the closing spring is discharged, and FIG. 6 is a state view showing the operation among the switching mechanism, the movable contactor connected to the switching mechanism, and the stationary contactor in the air circuit breaker according to the related art, which shows an operational state where the air circuit breaker is broken (tripped) and the closing spring is discharged.

Now, a case of manually switching a circuit off in the related art, or a case of automatically breaking (tripping) a circuit by sensing a fault current on the circuit will be described.

As shown in FIG. 5, in case where the air circuit breaker is manually switched off in a closed state, when a user presses the switch-off button 6, an off plate 39 is horizontally moved in a left side in FIG. 5, so as to press the off shaft 36, thereby rotating the off shaft 36.

Alternatively, upon performing an automatic trip operation, the overcurrent trip relay detects a fault current on the circuit, thus to generate and output a trip control signal to the actuator. The actuator then operates in response to the trip control signal. Accordingly, the output link and the first link unit of the actuator cooperate with each other to thusly be moved vertically. As a result, the off shaft 36 of the switching mechanism 30 is pressed by the first link unit to be rotated.

In any of the manual method or the automatic method, once the off shaft 36 is rotated, an open latch 37 is rotated to release a link unit 32. Thus, a closing spring 38, which is tensioned to be charged with an elastic energy in the closed state as shown in FIG. 5, discharges such elastic energy (i.e., returns to initial state shrunk as shown in FIG. 6), whereby a driving lever 51 connected to one end of the closing spring 38 is pulled up to thereby be counterclockwise rotated.

Accordingly, a main shaft 50 is rotated in the counterclockwise direction, and a connection link 52 having one end contacted by the driving lever 51 and the other end connected to the movable contactor 53 is moved to a right side in FIG. 5 so as to pull the movable contactor to the right side. The movable contactor 53 is then separated from an upper terminal 54*a* corresponding to a stationary contactor as shown in FIG. 6, thereby completing the manual trip operation or automatic trip operation to block the circuit. A lower terminal 54*b* is always electrically and mechanically connected to the movable contactor 53 by a connection member formed of an electric conductor (not shown).

A case of operating the related art air circuit breaker from an opened state to a closed state will now be described.

The state shown in FIG. 6 is a state where the movable contactor 53 is separated from the upper terminal 54*a* (i.e., circuit blocked state) but the closing spring 31 is not charged. In order for the movable contactor 53 to be driven to the closed state (i.e., circuit conducted state) in which it comes in contact with the upper terminal 54*a*, first of all, the closing spring 31 which applies a driving force for driving the movable contactor 53 should be charged as shown in the state of FIG. 4. The closing spring 31 is charged by several methods, for example, by unfolding a folded spring charging handle (no reference numeral given although shown on the main cover 2 of FIG. 1) to manually manipulate a cam shaft (no reference numeral given although shown in FIGS. 4 to 6), by driving a motor (not shown) to operate the cam shaft, and the like.

As such, under the state where the closing spring 31 is charged to thusly be in the state as shown in FIG. 4, when a user presses the switch-on button 5, an ON coupling 35 is rotated clockwise in FIG. 4 to restrict the closing latch 33. Accordingly, the ON shaft 34 maintaining the charged state of the closing spring 31 is pressed to be rotated in a counterclockwise direction, thereby releasing the closing latch 33. The link unit 32 is rotated counterclockwise by the closing spring 31 which discharges the charged elastic energy, thereby rotating the driving lever 51 connected to the link unit 32 in the clockwise direction, whereby the connection link 52 is moved in the left direction in FIG. 4 to allow the movable contactor 53 connected to the connection link 52 to come in contact with the upper terminal 54*a* corresponding to the stationary contactor, whereby the circuit is conducted (closed), thereby completing the closing operation.

In the related art air circuit breaker having such configuration, the overcurrent trip relay is implemented as an electric control circuit, it can remember (store) that it generated and outputted the control signal or display (indicate) such information on a display or the like.

However, the trip indicating function of the overcurrent trip relay merely denotes that it generated and outputted the control signal for the trip operation. For example, if the actuator received the control signal but failed to operate, it may fail to transfer a mechanical trigger signal to the switching mechanism. As a result, a trip operation is not performed and the trip indicated becomes false, which makes it impossible to ensure a reliability of the electronic trip indicating function of the overcurrent trip relay.

SUMMARY OF THE INVENTION

Therefore, an object of the present invention is to provide an air circuit breaker having a mechanical trip indicating mechanism capable of mechanically reliably indicating a user that the air circuit breaker is in a tripped state by indicating the operation of an actuator through a mechanical connection.

To achieve these and other advantages and in accordance with the purpose of the present invention, as embodied and broadly described herein, there is provided an air circuit breaker having a stationary contactor connected to a circuit and a movable contactor movable to a closing position where the movable contactor comes in contact with the stationary contactor to conduct the circuit or a trip position where the movable contactor is separated from the stationary contactor to block the circuit, comprising: a switching mechanism connected to the movable contactor to drive the movable contactor to move to the closing position or the trip position; an overcurrent trip relay configured to compare a conductive current reference value, which is predetermined to determine whether a fault current has been generated on the circuit, with a conductive current value detected on the circuit, to determine whether a fault current has been generated, and to output an electric trip control signal when being determined the fault current has been generated; an actuator configured to provide a mechanical trigger signal so as to trip the switching mechanism according to the electric trip control signal from the overcurrent trip relay; a first link unit connected between the actuator and the switching mechanism and configured to transmit the mechanism trigger signal from the actuator to the switching mechanism; a mechanical trip indicating mechanism configured to mechanically indicate at a front surface of the air circuit breaker that the trip operation has been performed; and a driving force generator for a trip indication connected both to the actuator and to the mechanical trip indicating mechanism, and configured to drive the mechanical trip indicating mechanism to provide the indication of the trip operation in response when the mechanical trigger signal for the trip operation is generated from the actuator.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The objects, configuration to achieve such objects and operational effect of the present invention will be understood by description herein of the preferred embodiments of the present invention in conjunction with the accompanying drawings.

Figure 7:
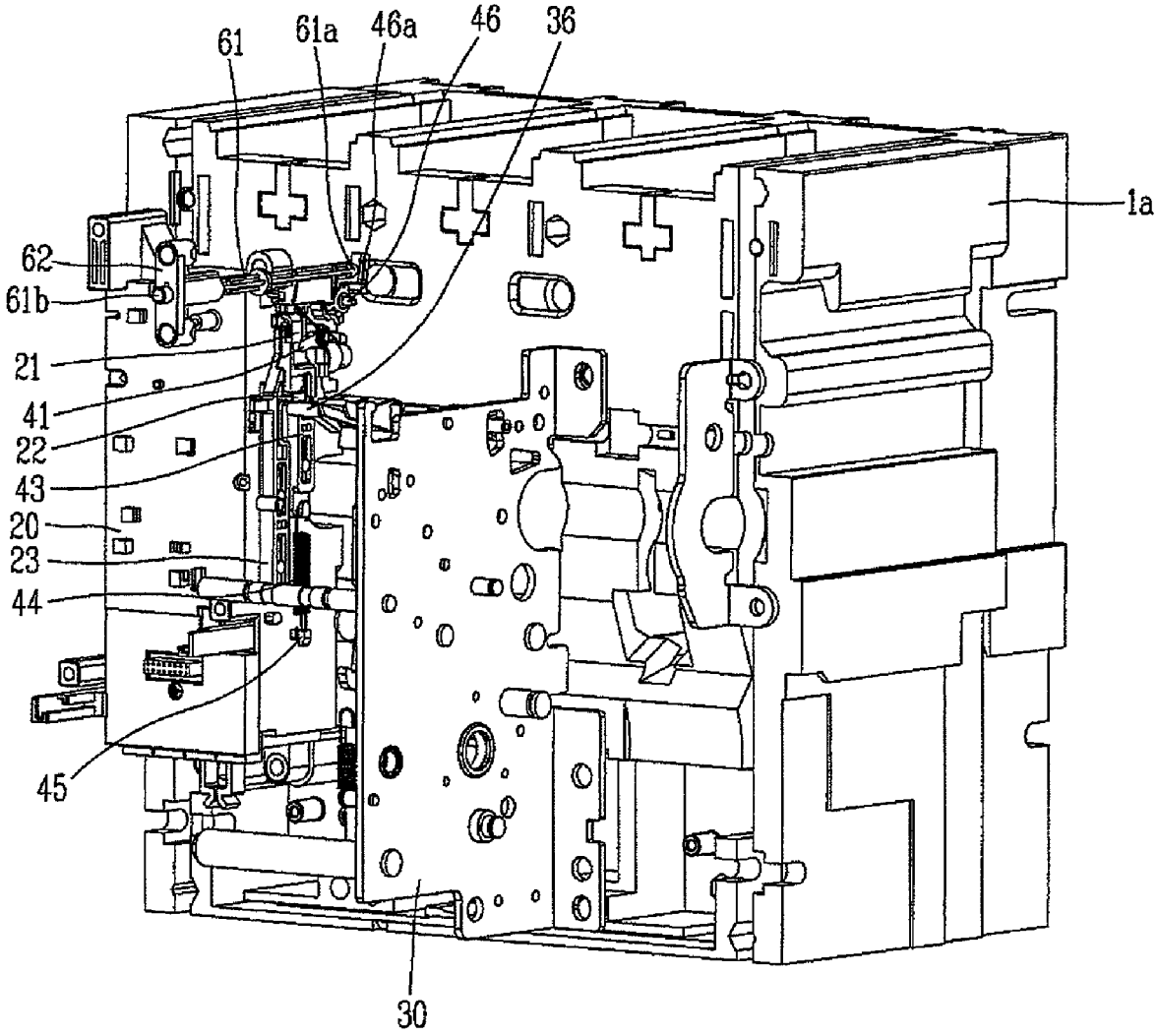
FIG. 7 is a perspective view showing a connected state among an actuator, a mechanism for transferring a mechanical trigger signal and a switching mechanism all for a trip operation in a state of a front main cover being removed from an air circuit breaker according to the present invention.

First, FIG. 7 is a perspective view showing a connected state among an actuator, a driving force transmitting unit and a switching mechanism all for a trip operation under the state of a front main cover being removed from an air circuit breaker according to the present invention, which will be described hereinafter.

Figure 1:
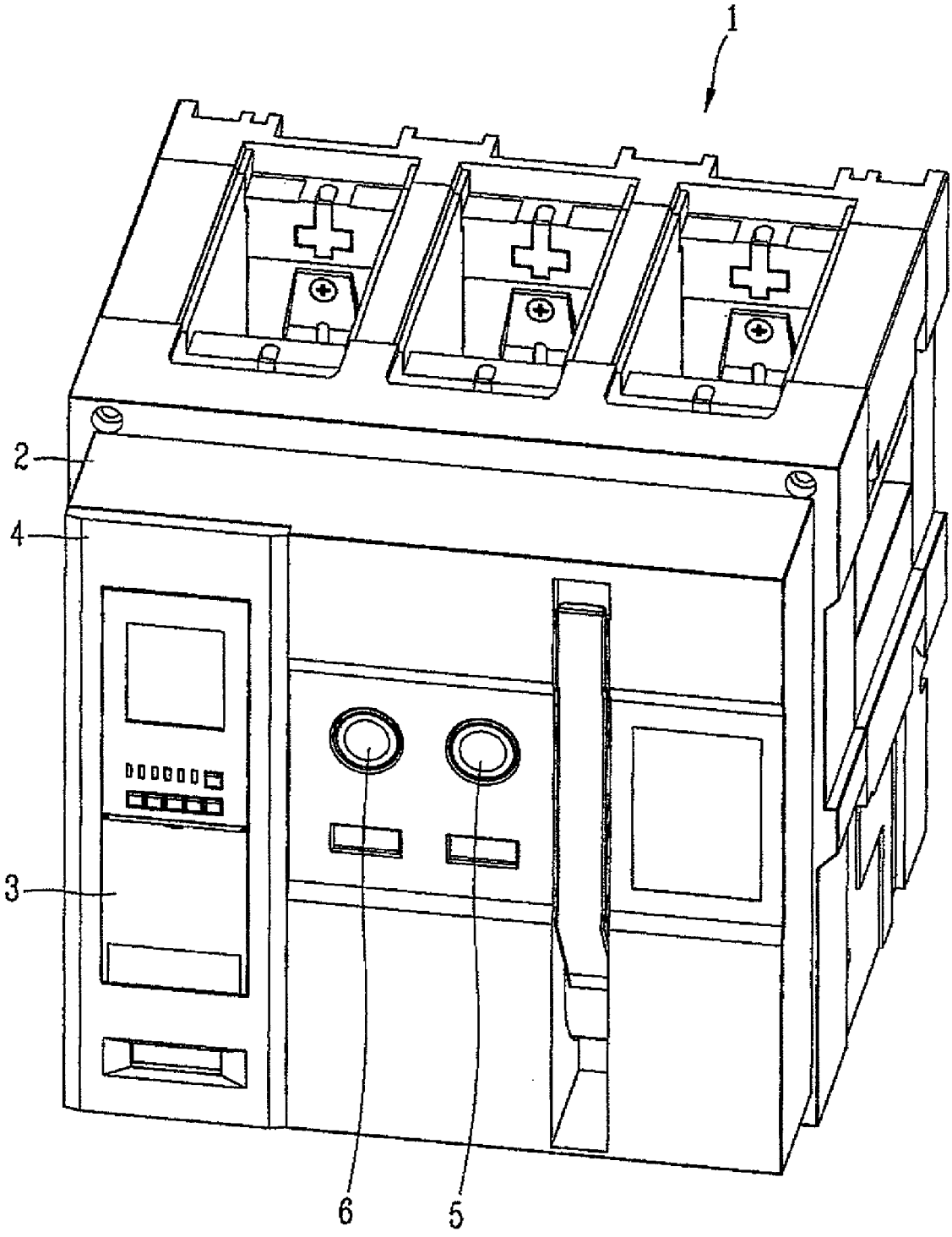
FIG. 1 RELATED ART
FIG. 1 is a perspective view showing an overall outer appearance of an air circuit breaker according to the related art.
Figure 2:
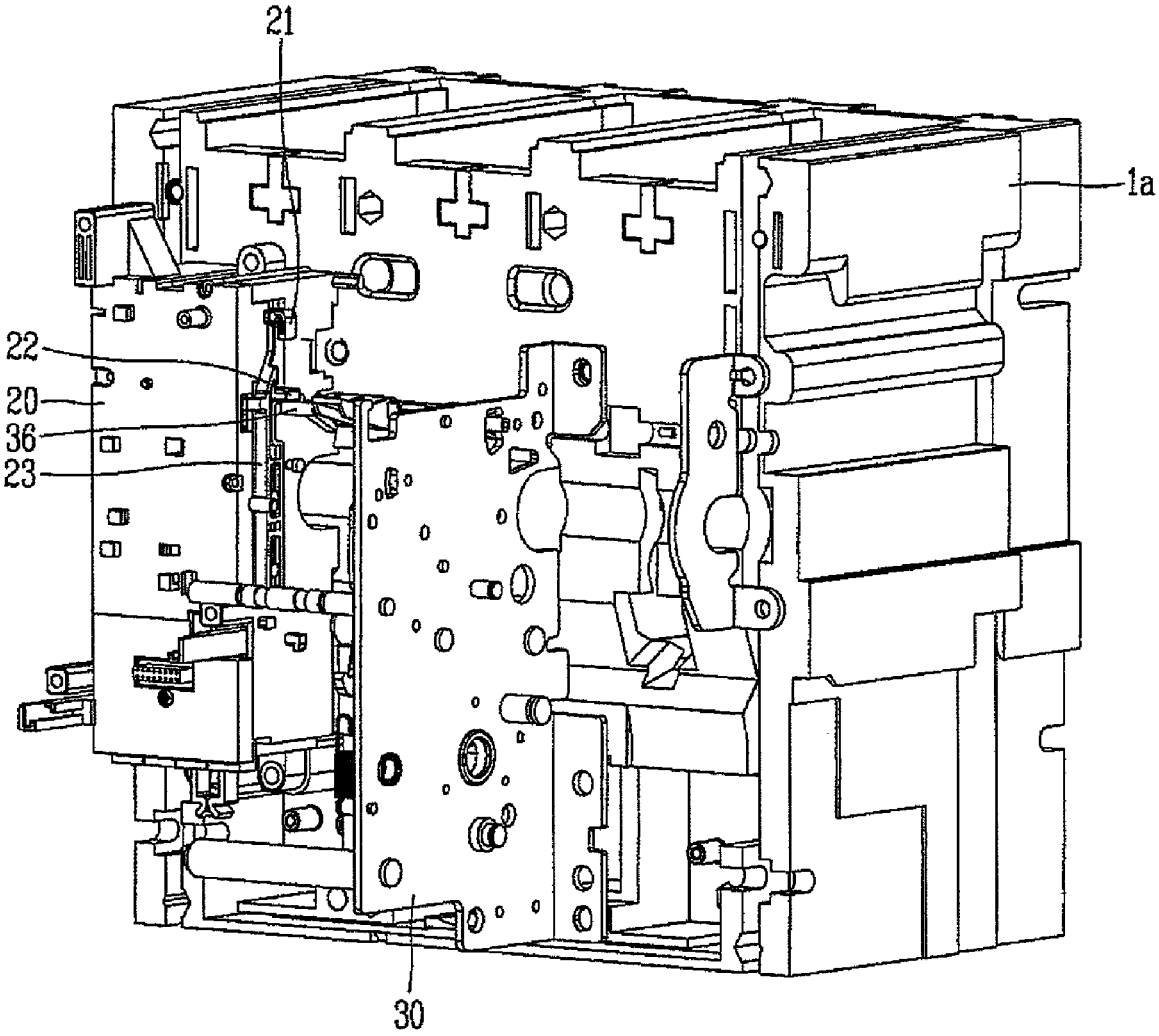
FIG. 2 RELATED ART
FIG. 2 is a perspective view showing a connecting relation among an actuator, a mechanism for transferring a mechanical trigger signal and a switching mechanism all for a trip operation in a state of a front main cover being removed from the air circuit breaker according to the related art.
Figure 3:
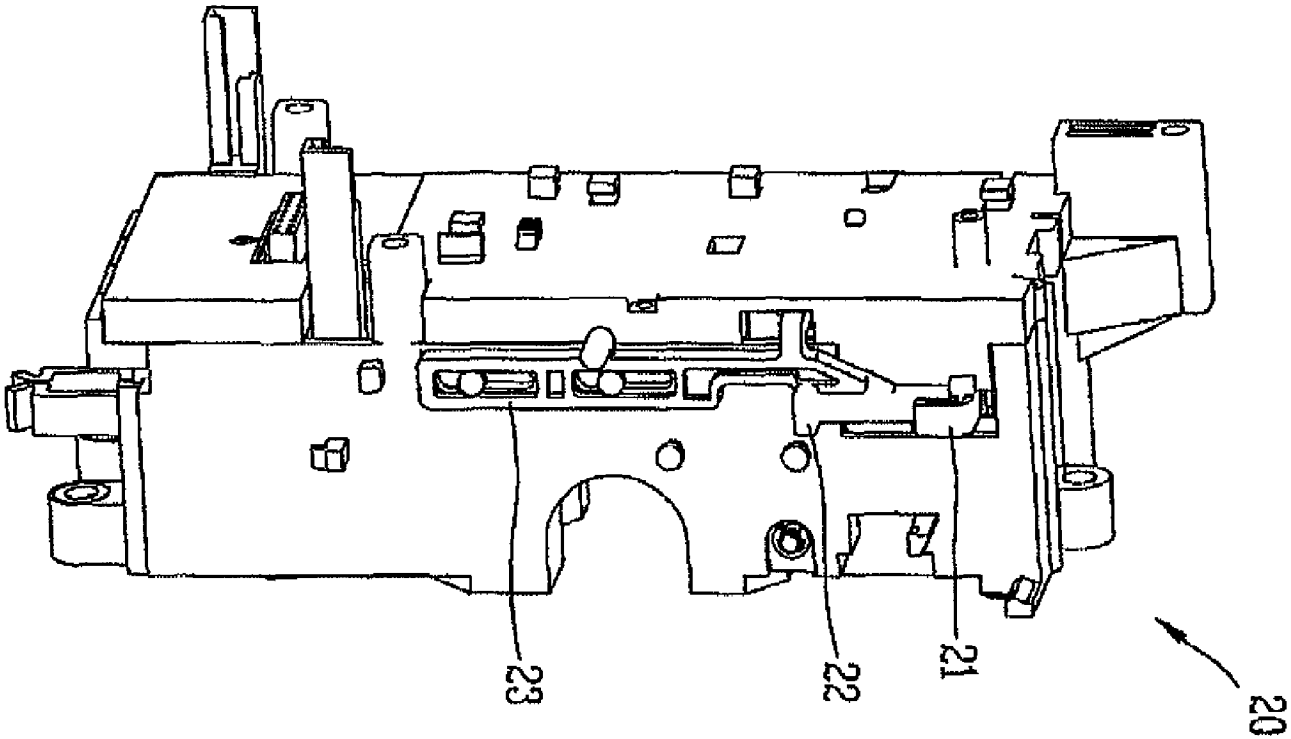
FIG. 3 RELATED ART
FIG. 3 is a perspective view separately showing the actuator and the mechanism for transferring the mechanical trigger signal in the air circuit breaker according to the related art.
Figure 4:
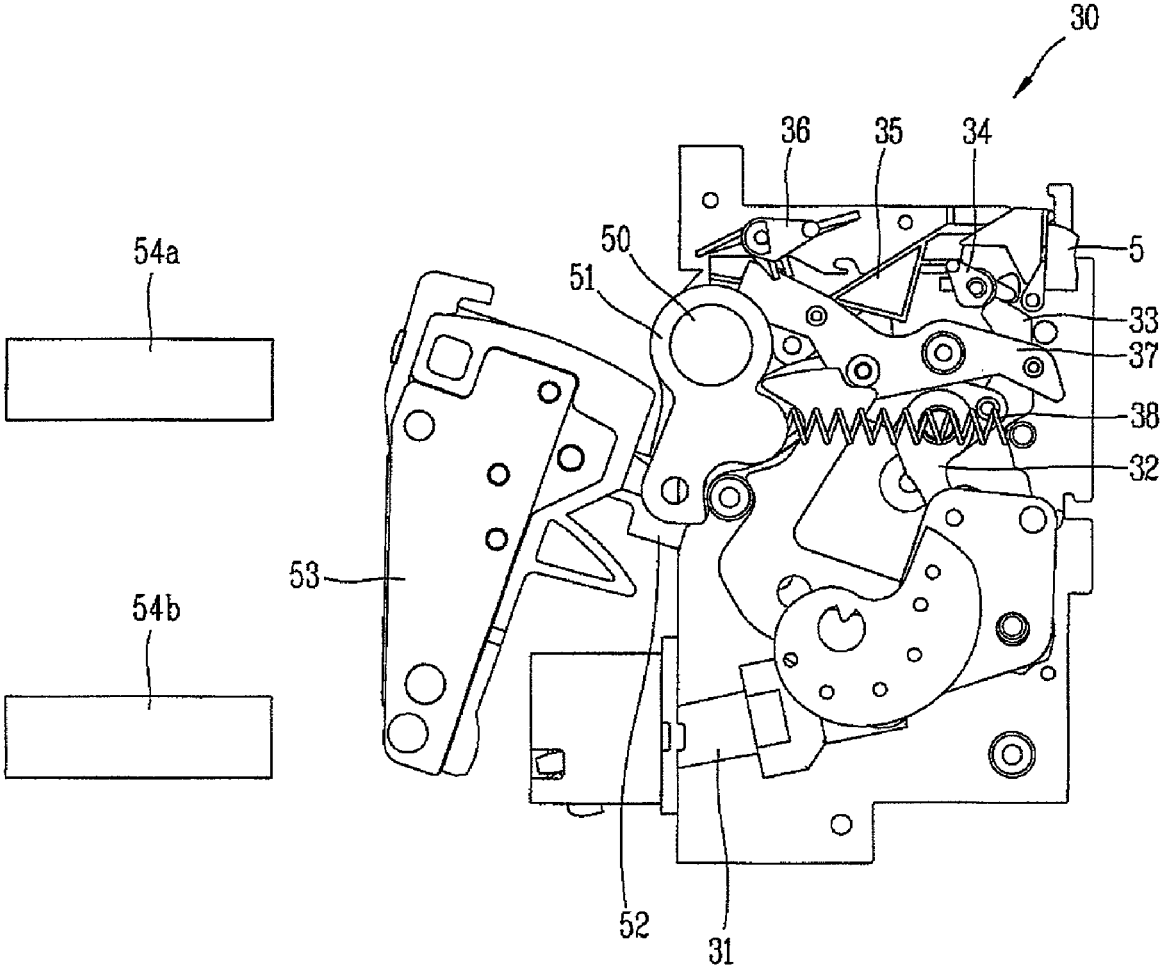
FIG. 4 RELATED ART
FIG. 4 is a state view showing the operation among a switching mechanism, a movable contactor connected to the switching mechanism, and a stationary contactor in the air circuit breaker according to the related art, which shows an operational state where the air circuit breaker is broken (tripped, blocked) and a closing spring is charged.
Figure 5:
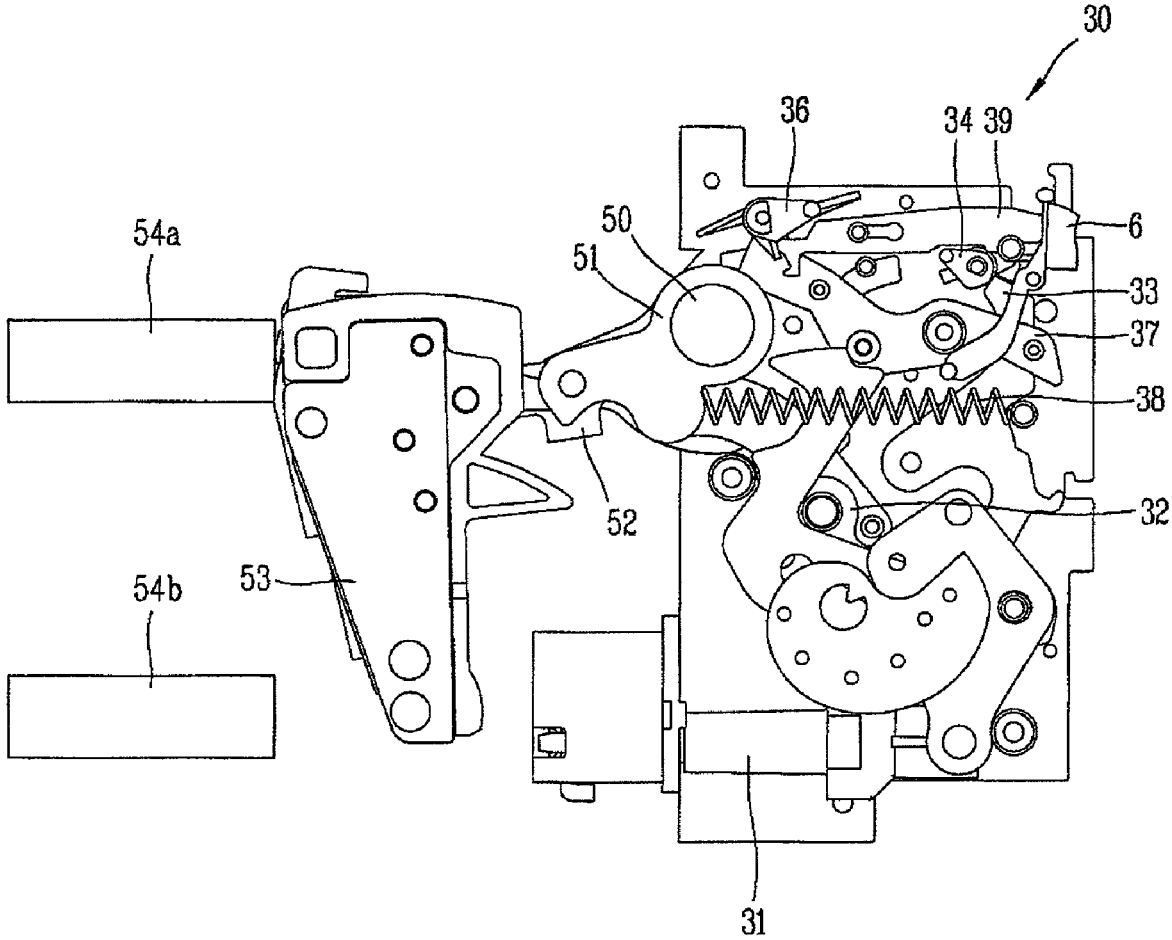
FIG. 5 RELATED ART
FIG. 5 is a state view showing the operation among the switching mechanism, the movable contactor connected to the switching mechanism, and the stationary contactor in the air circuit breaker according to the related art, which shows an operational state where the air circuit breaker is closed (conducted) and the closing spring is discharged.
Figure 6:
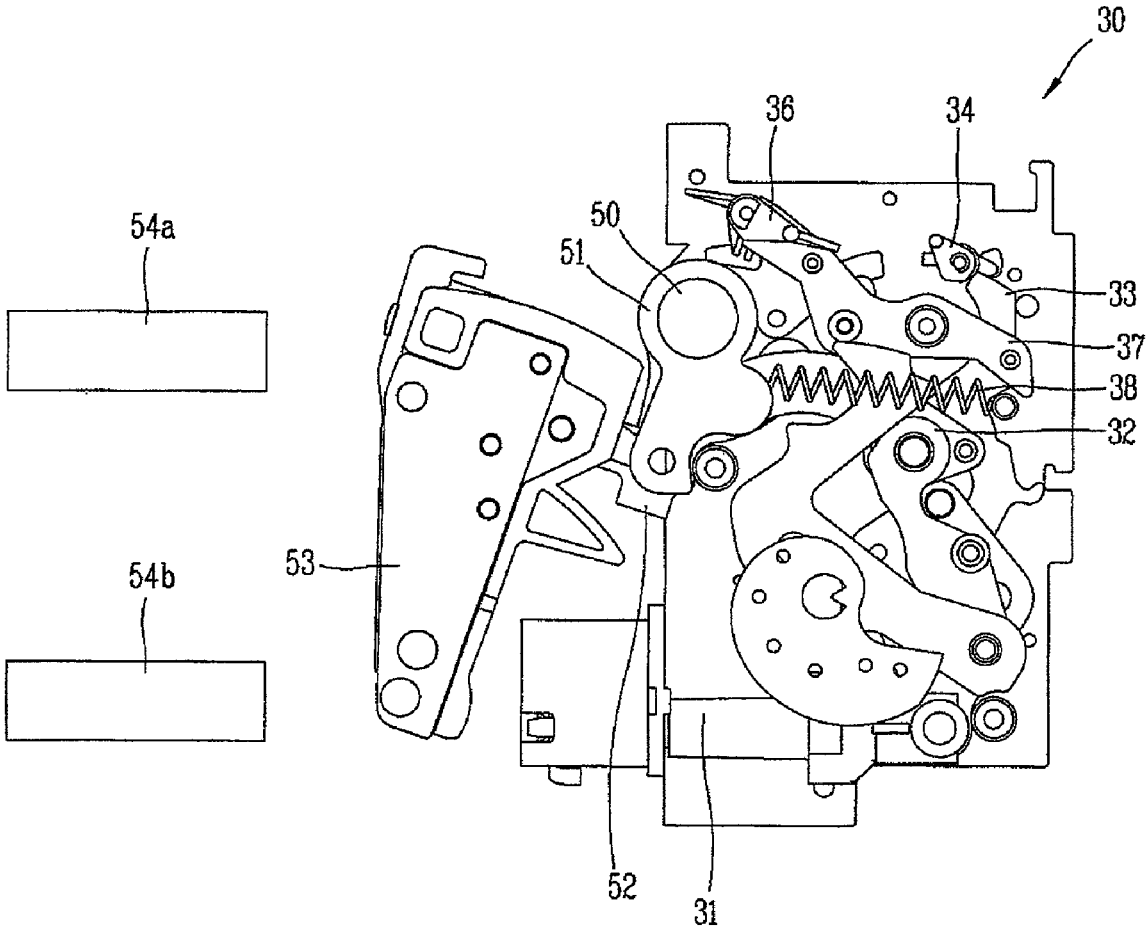
FIG. 6 RELATED ART
FIG. 6 is a state view showing the operation among the switching mechanism, the movable contactor connected to the switching mechanism, and the stationary contactor in the air circuit breaker according to the related art, which shows an operational state where the air circuit breaker is broken (tripped) and the closing spring is discharged.

The air circuit breaker according to the present invention may include a stationary contactor connected to a circuit and a movable contactor movable between a closing position where it is connected to the stationary contactor to conduct the circuit and a trip (open) position where it is disconnected from the stationary contactor to block the circuit. Such configuration is well known as a basic configuration of an air circuit breaker, and is the same as that of the related art aforementioned with reference to FIGS. 4 to 6.

Also, as shown in FIG. 7, the air circuit breaker according to the present invention may include a switching mechanism 30 connected to the movable contactor to move to the closing position or the trip position. The switching mechanism 30 has the same configuration and effects as those of the switching mechanism according to the related art having described with reference to FIGS. 4 to 6, and thus its description will not be repeated.

Figure 12:
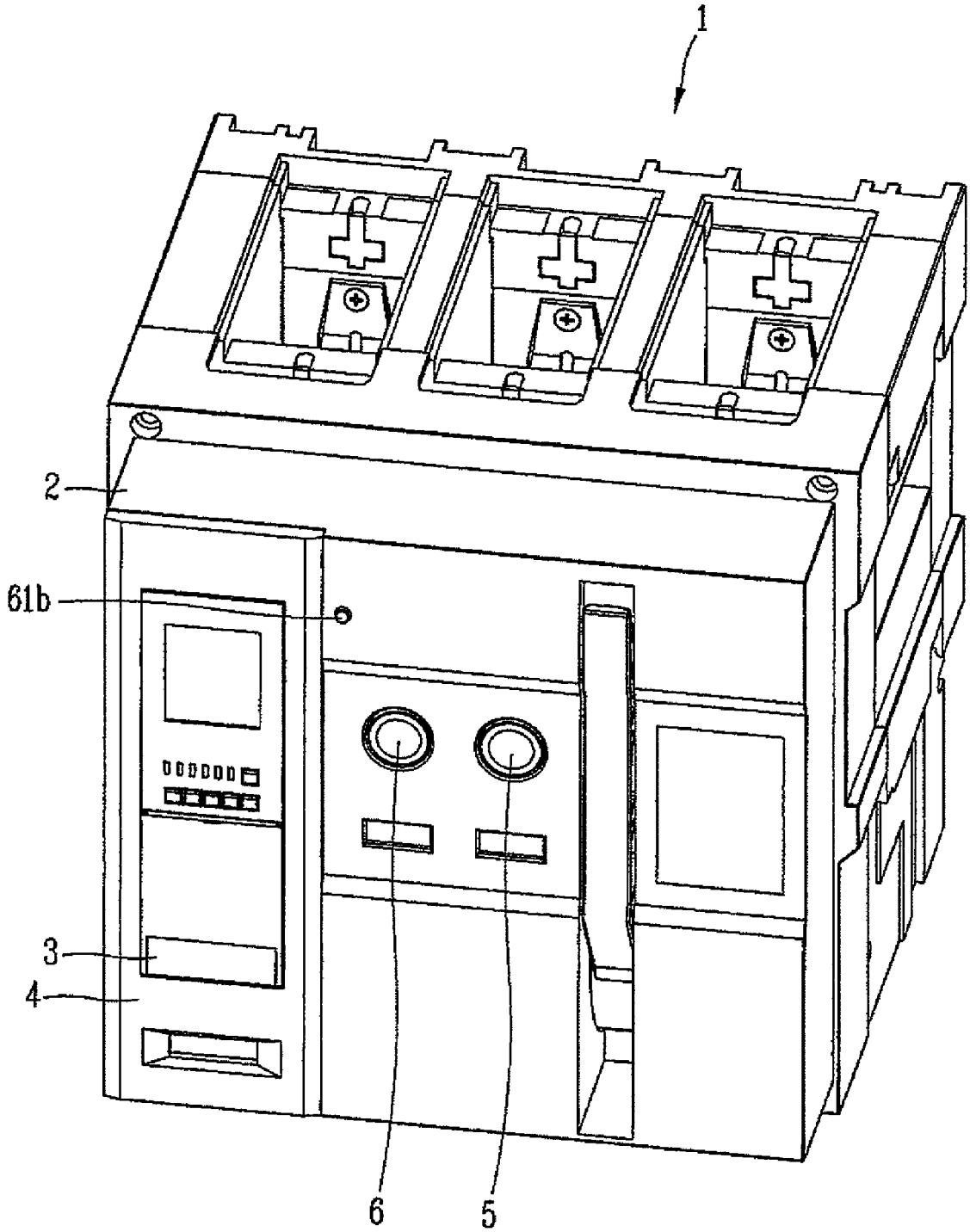
FIG. 12 is a perspective view of an outer appearance of the air circuit breaker which shows that the mechanical trip indicating mechanism indicates on the front surface of the air circuit breaker that a trip operation has been performed according to the present invention.

Still referring to FIG. 7, the air circuit breaker according to the present invention may include an overcurrent trip relay (not shown, but its outer appearance can see the reference numeral 3 in FIG. 12). The overcurrent trip relay is configured to set a conductive current reference value for determining whether a fault current is generated on the circuit, to compare the set (predetermined) conductive current reference value with a detected conductive current value on the circuit, to determine whether a fault current has been generated, and to output a trip driving control signal to trip the switching mechanism when determined the generation of the fault current.

The overcurrent trip relay included in the air circuit breaker according to the present invention is an electronic control part including a setup knob which sets a current reference value for determining whether a fault current is generated (e.g., a current value which is not much greater than a rated current and temporarily allowable to be conducted, an allowable trip operation time, a current value which should be blocked instantaneously, a short-circuit current value, and the like), and an electronic circuit such as a microprocessor which compares the setup reference value with a detected current value on the circuit, determines whether to perform a trip operation, and generates and outputs a control signal indicating the trip operation when being determined the trip operation to be performed. The functions and configuration of the overcurrent trip relay are already well-known and has no direct relation to the present invention, explanation of which will thusly be omitted.

Still referring to FIG. 7, the air circuit breaker according to the present invention may include an actuator 20 which provides a mechanical trigger signal for tripping the switching mechanism 30 based upon a trip driving control signal from the overcurrent trip relay.

The actuator 20 may be implemented as, for example, a solenoid coil actuator having a moving portion which is linearly movable by an attraction of an electromagnetic coil. The actuator 20 is the same as the related art actuator adapting such well-known technology and is not any characterizing component of the present invention. Thus, its detailed configuration and operations will not be described.

An output link 21 corresponding to an output unit of the actuator 20 protrudes from an opening at a side face of the actuator 20 to transfer a mechanical trigger signal and is movable in a vertical direction.

Also, as shown in FIG. 7, the air circuit breaker according to the present invention may further include a first link unit 23 which is connected between the actuator 20 and the switching mechanism 30 to transfer the mechanical trigger signal from the actuator 20 to the switching mechanism 30. The first link unit 23 has the same configuration and function as those of the aforesaid first link unit 23 according to the related art. The first link unit 23 contacts the output link 21 which vertically moves down at the side surface of the actuator 20, thus to transfer such vertical force to an OFF shaft 36 of the switching mechanism 30 via a protrusion 22 of the first link unit 23.

The switching mechanism 30 is disposed adjacent to the actuator 20. When the protrusion 22 of the first link unit 23 presses the OFF shaft 36, the switching mechanism, in response, applies a driving force such that the movable contactor is separated from the stationary contactor to thereby break (open) the circuit. The switching mechanism 30 has the same or similar configuration and operation as the aforesaid switching mechanism of the related art, and its detailed description will be omitted accordingly.

The air circuit breaker according to the present invention may further include a mechanical trip indicating mechanism (no reference numeral given in FIG. 7 but possibly see 60 in FIGS. 9 and 10) which is a characterizing component of the present invention for mechanically indicating on a front surface of the air circuit breaker that a trip operation has been performed.

The air circuit breaker according to the present invention may further include a driving force generator for a trip indication connected to both the actuator 20 and the mechanical trip indicating mechanism to drive the mechanical trip indicating mechanism to perform a trip indication in response when the mechanical driving force for the trip operation is generated from the actuator 20.

Figure 8:
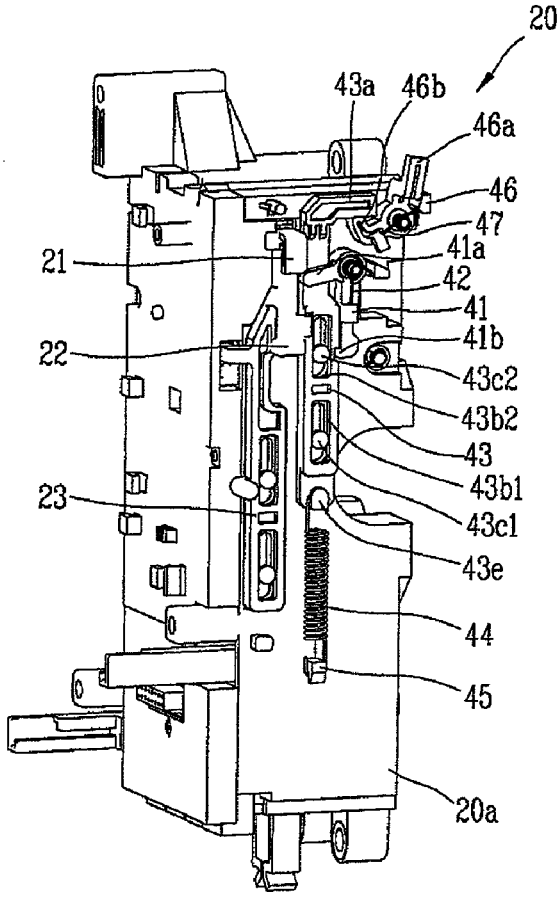
FIG. 8 is a perspective view showing an output unit of the actuator, a mechanism for transferring a mechanical trigger signal and a driving force generator for a trip indication in the air circuit breaker according to the present invention.

FIG. 8 is a perspective view showing an output unit of the actuator, a mechanism for transferring a mechanical trigger signal and a driving force generator for a trip indication in the air circuit breaker according to the present invention. The configurations thereof will now be described.

In FIG. 8, reference numeral 20 denotes the actuator, 21 denotes the output link as the output unit of the actuator 20 as aforementioned, 23 denotes the first link unit, and 22 denotes the protrusion of the first link unit 23.

As shown in FIG. 8, the air circuit breaker according to the present invention may include a driving force generator for a trip indication as a characterizing component. The driving force generator may include a second link unit 43 vertically movable, a driving spring 44 having one end connected to the second link unit 43 and the other end supported by a side wall 20*a* of the actuator 20 so as to apply an elastic biasing force to the second link unit 43 to thusly move in the vertical direction, and a second rotation lever 46 connected to the second link unit 43 to be rotatable by the second link unit 43 moving in the vertical direction, and contacting the mechanical trip indicating mechanism aforementioned with reference to FIG. 7 to apply a driving force thereto for the trip indication.

In FIG. 8, the second rotation lever 46 is rotatably disposed on the side wall 20*a* of the actuator 20. The second rotation lever 46 may include a driving force transmitting unit 46*a* for supplying (transmitting) a driving force to the mechanical trip indicating mechanism, and a driving force receiving unit 46*b* for receiving a rotation driving force from the second link unit 43.

In FIG. 8, the air circuit breaker according to the present invention may further include, as a characterizing component, a second return spring 47 for return the second rotation lever 46 to its initial position when no mechanical trigger signal is received from the output link 21 of the actuator 20.

The driving force generator may further include restricting units (i.e., 41 and 42) which are connected to the output link 21 of the actuator 20 outputting the mechanical trigger signal and contactable with the second link unit 43, so as to release the second link unit 43 to thusly be vertically movable when the mechanical trigger signal is outputted from the actuator 20, and to restrict the vertical movement of the second link unit 43 when the mechanical trigger signal is not outputted.

The restricting units (41 and 42) may include a first rotation lever 41 having a rotation force receiving lever portion 41*a* coming in contact with the output link 21 as the output unit of the actuator 20 thus to receive a rotation driving force, and a hook portion 41*b* connected to the rotation force receiving lever portion 41*a* so as to be rotatable according to the rotation of the rotation force receiving lever portion 41*a* to a position at which the vertical movement of the second link unit 43 is restricted or to a position at which the vertical movement is allowable. The restricting units (41 and 42) may include a restricting bias spring 42 which supplies an elastic biasing force to the first rotation lever 41 such that the hook portion 41*b* can be rotated to the position of restricting the first link unit 43. The restricting bias spring 42 is preferably implemented as a torsion spring.

The actuator 20 is provided with first and second stoppers 43*c*1 and 43*c*2 integrally fixed or protruding to or from the side wall of the actuator 20 to limit the distance of the vertical movement of the second link unit 43.

The second link unit 43 may include first and second long hole portions 43*b*1 and 43*b*2 limitedly movable in the vertical direction by the first and second stoppers 43*c*1 and 43*c*2, and a driving force transmitting lever 43*a* contacted with the second rotation lever 46 to supply (transmit) a rotation driving force to the second rotation lever 46. The second link unit 43 is provided with a hook inserting groove (not shown) at a position facing the hook portion 41*b* on the right side wall in FIG. 8. The hook inserting groove (not shown) allows such that the hook portion 41*b* of the first rotation lever 41 can be inserted thereinto or released therefrom to restrict the vertical movement of the second link unit 43 or release it.

Unexplained reference numeral 43*e* denotes a spring upper end supporting portion which supports the upper end of the driving spring 44, and 45 denotes a spring lower end supporting portion protruding from the side wall 20*a* of the actuator 20.

Figure 9:
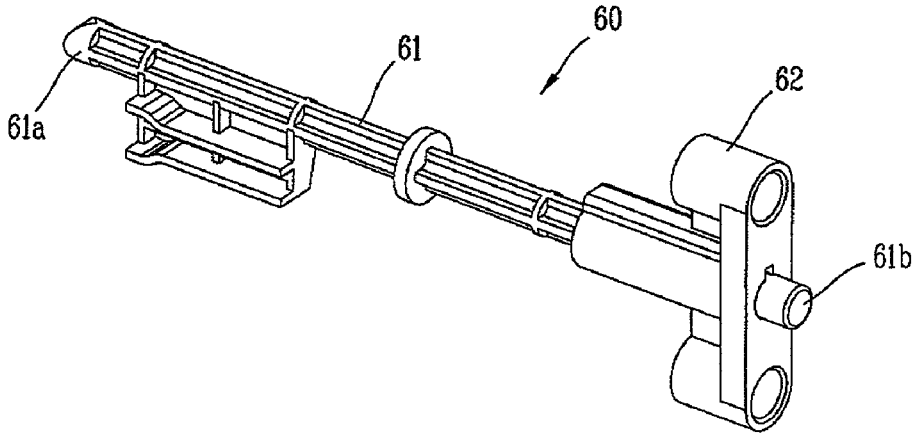
FIG. 9 is a perspective view showing an assembled state of a mechanical trip indicating mechanism in the air circuit breaker according to the present invention.
Figure 10:
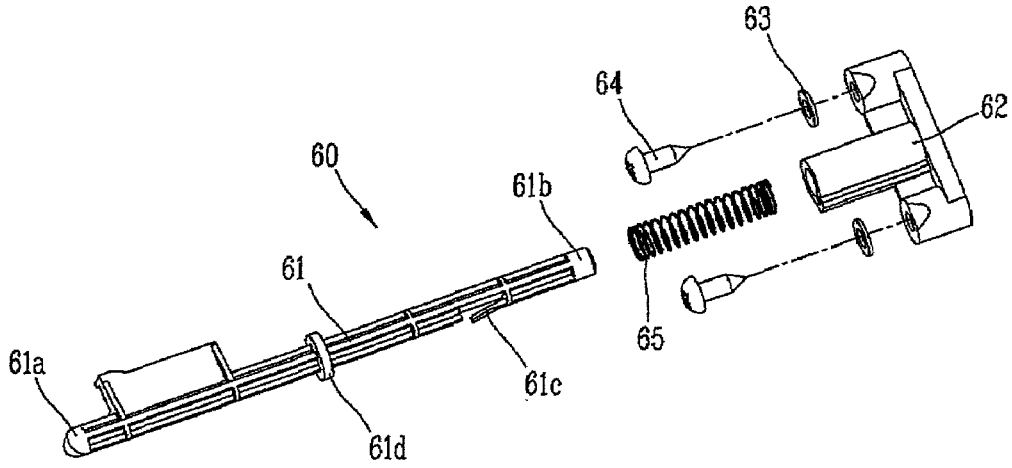
FIG. 10 is a disassembled view showing in detail components of the mechanical trip indicating mechanism in the air circuit breaker according to the present invention.
Figure 11:
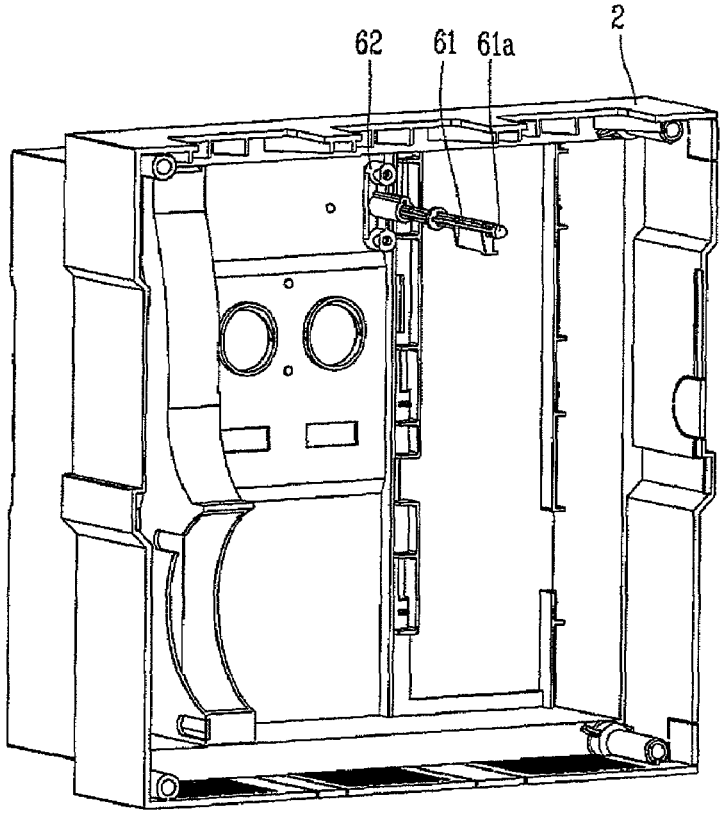
FIG. 11 is a rear perspective view of a main cover in a state where the mechanical trip indicating mechanism is installed at the main cover disposed at a front side of the air circuit breaker according to the present invention.

FIG. 9 is a perspective view showing an assembled state of a mechanical trip indicating mechanism in the air circuit breaker according to the present invention, FIG. 10 is a disassembled view thereof, and FIG. 11 is a rear perspective view of a main cover in a state where the mechanical trip indicating mechanism is installed at the main cover disposed at a front side of the air circuit breaker according to the present invention. Such configuration will be described hereafter.

As shown in the assembled state of FIG. 9, the mechanical trip indicating mechanism 60 in the air circuit breaker according to the present invention may include a trip indicating rod 61 having one end portion as an indicating portion 61*b* exposed at the front surface of the air circuit breaker to indicate the blocked state of the air circuit breaker and the other end portion as a driving force receiving portion 61*a* for receiving a horizontal driving force for exposing the one end portion. Also, the mechanical trip indicating mechanism 60 may include a guiding member 62 fixed to a rear side of the front surface of the air circuit breaker to guide the trip indicating rod 61 to move horizontally. The mechanical trip indicating mechanism 60 may also include a first return spring 65 (see 65 in FIG. 10) for applying an elastic biasing force to the trip indicating rod 61 in a direction opposite to moving to be exposed to the front surface. The mechanical trip indicating mechanism 60 may also include a spring separation preventing portion 61*c* for preventing the separation of the first return spring 65, guiding member fixing screws 64 for fixing the guiding member 52 to a front surface of the air circuit breaker, namely, to the rear surface of the main cover 2 at the front surface as shown in FIG. 11, and washers 63 for preventing the guiding member fixing screws 64 from being loose.

The guiding member 62 is configured as a member having screw insertion holes at its both sides and a cylindrical portion accommodating the trip indicating rod 61 and the first return spring 65 in its center.

In FIG. 10, unexplained reference numeral 61*d* denotes a spring seat for supporting the rear side of the first return spring 65. The spring seat 61*d* may serve as a spring pressing portion for pressing the first return spring 65 to be compressed when the trip indicating rod 61 is moved in the direction to expose the indicating portion 61*b* to the front surface. Also, when the horizontal driving force transferred via the driving force receiving portion 61*a* of the trip indicating rod 61 is no longer applied, the spring seat 61*d* may serve as a portion to which a return force is applied, the return force being supplied from the first return spring 65 to return the trip indicating rod 61 so as not to be exposed to the front surface of the air circuit breaker any more.

Thus, the indicating portion 61*b* of the trip indicating rod 61 is inserted into the first return spring 65 such that the first return spring 65 can be installed between the spring separation preventing portion 61*c* and the spring seat 61*d*. Such first return spring 65 is then inserted into the central cylindrical portion of the guiding member 62.

A mechanical trip indicating operation of the air circuit breaker according to the present invention having such configuration will now be described with reference to FIGS. 7 to 12.

As shown in FIG. 12, when the overcurrent trip relay 3 detects a fault current on the circuit and generates an electric control signal for a trip operation to transfer to the actuator 20, the output link 21 as the output unit of the actuator 20 is lowered as shown in FIGS. 7 and 8 responsive to the mechanical control signal from the overcurrent trip relay 3 and accordingly the actuator generates a mechanical trigger signal.

The lowering of the output link 21 as the mechanical trigger signal of the actuator 20 makes the first link unit 23 connected to the output link 21 move down. Accordingly, the protrusion 22 of the first link unit 23 presses the OFF shaft 36 of the switching mechanism 30 to rotate it, thereby allowing the trip operation (i.e., automatic circuit blocking) similar to the description of the trip operation according to the related art with reference to FIGS. 4 to 6.

Simultaneously, the output link 21 gets over the restricting bias force of the restricting bias spring 42 to rotate the rotation force receiving lever portion 41*a* of the first rotation lever 41 in a counterclockwise direction in FIG. 8.

Accordingly, the hook portion 41*b* connected to the rotation force receiving lever portion 41*a* is rotated to the position where the vertical movement of the second link unit 43 is allowable according to the counterclockwise rotation of the rotation force receiving lever portion 41*a*.

Thus, the second link unit 43 is pulled down by an elastic driving force of the driving spring 44 connected to the lower end of the second link unit 43. Here, the second link unit 43 is linearly guided in the vertical direction as the first and second long holes 43*b*1 and 43*b*2 are guided by the first and second stoppers 43*c*1 and 43*c*2.

As the second link unit 43 is moved down, the driving force transmitting lever 43*a* disposed at the upper end of the second link unit 43 rotates the second rotation lever 46. That is, the driving force transmitting lever 43*a* supplies a rotation driving force to the driving force receiving unit 46*b* of the second rotation lever 47. The second rotation lever 46 then overcomes the elastic return force of the second return spring 47 to be rotated in the counterclockwise direction in FIG. 8.

Hence, the driving force transmitting unit 46*a* of the second rotation lever 46 is rotated in the counterclockwise direction. The driving force transmitting unit 46*a* presses the driving force receiving portion 61*a* of the trip indicating rod 61 located at the front side thereof. Accordingly, the trip indicating rod 61 is moved forwardly, namely, is moved horizontally to be exposed or protruded to the outside of the front main cover 2 of the air circuit breaker 1 in FIG. 12.

As a result, as shown in FIG. 12, a user can see the indicating portion 61*b* of the trip indicating rod 61 exposed or protruded outside the front main cover 2 of the air circuit breaker 1, and accordingly can recognize that the trip operation of the air circuit breaker has been performed.

Also, if there is not the mechanical trigger signal from the actuator 20, namely, if the output link 21 is moved upwardly, the first link unit 23 is also moved upwardly. Accordingly, the rotation driving force which is applied from the output link 21 to the rotation force receiving lever portion 41*a* of the first rotation lever 41 is not applied any more. Afterwards, the hook portion 41*b* of the first rotation lever 41 is inserted into the hook insertion hole (not shown) formed in the side wall surface of the second link unit 43 by the restricting bias force of the restricting bias spring 42, so as to restrict the second link unit 43 again. Accordingly, the rotation driving force applied to the driving force receiving unit 46*b* is not applied any more, whereby the return force of the second return spring 47 is applied to the second rotation lever 46.

The driving force transmitting unit 46*a* of the second rotation lever 46 is retreated to the position separated from the driving force receiving portion 61*a* of the trip indicating rod 61. Thus, the pressure applied in the direction of exposing the trip indicating rod 61 outside the front surface of the air circuit breaker 1 is disappeared. Accordingly, the trip indicating rod 61 is retreated by the elastic force of the first return spring 65 such that it cannot be exposed or protruded any more from the front side of the air circuit breaker 1, namely, from the front surface of the main cover 2 in the FIG. 12.

Thus, due to the state that the indicating portion 61*b* of the trip indicating rod 61 is not exposed or protruded from the front surface of the main cover 2 in FIG. 12, then a user can recognize that the trip operation has not been performed.

Unexplained reference numeral 4 in FIG. 12 denotes an auxiliary cover, 5 denotes a switch-on button, and 6 denotes a switch-off button.

As described above, in the air circuit breaker having the mechanical trip indicating mechanism according to the present invention, an indication as to that a trip operation has been performed is mechanically provided in cooperation only when a mechanical trigger signal is generated from an actuator, namely, when an output link of the actuator is lowered. Hence, a malfunction upon the indication as to whether the trip operation has been performed can be prevented, which is caused due to the mal-operation of the actuator, thereby enhancing a reliability of the air circuit breaker and also safely protecting a user from an electric accident.

In providing the air circuit breaker having the mechanical trip indicating mechanism according to the present invention, the operations of the actuator can be indicated in a mechanical connection, such that a user can reliably and mechanically be known that a trip operation has been performed in the air circuit breaker. Also, the user can be protected more safely from an electronic accident.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An air circuit breaker having a stationary contactor connected to a circuit and a movable contactor movable to a closing position where the movable contactor comes in contact with the stationary contactor to conduct the circuit or to a trip position where the movable contactor is separated from the stationary contactor to block the circuit, comprising:

a switching mechanism connected to the movable contactor to drive the movable contactor to move to the closing position or the trip position;

an overcurrent trip relay configured to compare a conductive current reference value, which is predetermined to determine whether a fault current has been generated on the circuit, with a current value detected on the circuit, to determine whether a fault current has been generated, and to output an electric trip control signal when being determined the fault current has been generated;

an actuator configured to provide a mechanical trigger signal so as to trip the switching mechanism according to the electric trip control signal from the overcurrent trip relay;

a first link unit connected between the actuator and the switching mechanism and configured to transmit the mechanism trigger signal from the actuator to the switching mechanism;

a mechanical trip indicating mechanism configured to mechanically indicate at a front surface of the air circuit breaker that the trip operation has been performed; and a driving force generator for a trip indication connected both to the actuator and to the mechanical trip indicating mechanism, and configured to drive the mechanical trip indicating mechanism to provide the indication of the trip operation in response to the mechanical trigger signal generated by the actuator.

2. The air circuit breaker of claim 1, wherein the mechanical trip indicating mechanism comprises:

a trip indicating rod including an indicating portion configured to indicate that the air circuit breaker is in a tripped state by being exposed to the front surface of the air circuit breaker, and a driving force receiving portion configured to receive a horizontal driving force for exposing the indicating portion;

a guiding member fixed to a rear side of the front surface of the air circuit breaker and configured to guide the horizontal movement of the trip indicating rod; and a first return spring configured to apply an elastic biasing force to the trip indicating rod in a direction opposite to a direction in which the trip indicating rod is moved to be exposed to the front surface.

3. The air circuit breaker of claim 1, wherein the driving force generator for the trip indication comprises:

a second link unit vertically movable;

a driving spring connected to the second link unit to supply an elastic biasing force to move the second link unit in a vertical direction; and a rotation lever connected to the second link unit to be rotatable by the second link unit which moves in the vertical direction, and coming in contact with the mechanical trip indicating mechanism to apply a driving force for the trip indication to the mechanical trip indicating mechanism.

4. The air circuit breaker of claim 3, wherein the driving force generator for the trip indication further comprises:

restricting units connected to an output unit of the actuator and contactable with the second link unit, wherein when the mechanical trigger signal is outputted from the actuator, the restricting units release the second link unit to be vertically movable, and when the mechanical trigger signal is not outputted, the restricting units restrict the vertical movement of the second link unit.

5. The air circuit breaker of claim 4, wherein the restricting units comprise:

a first rotation lever having a rotation force receiving lever portion contactable with the output unit of the actuator to receive a rotation driving force, and a hook portion connected to the rotation force receiving lever portion and rotatable to a position of restricting the vertical movement of the second link unit or to a position of allowing the vertical movement thereof according to the rotation of the rotation force receiving lever portion; and a restricting bias spring configured to provide an elastic biasing force to the first rotation lever to rotate the hook portion toward the position of restricting the vertical movement of the second link unit.

6. An air circuit breaker having a mechanical trip indicating mechanism, in an air circuit breaker including a stationary contactor connected to a circuit, a movable contactor movable to a closing position where the movable contactor comes in contact with the stationary contactor to conduct the circuit or a trip position where the movable contactor is separated from the stationary contactor to block the circuit, a switching mechanism for driving the movable contactor to move to the closing position or the trip position, an overcurrent trip relay for comparing a conductive current reference value, which is predetermined to determine whether a fault current has been generated on the circuit, with a current value detected on the circuit, determining whether a fault current has been generated, and outputting an electric trip operation control signal to trip the switching mechanism when being determined the fault current has been generated, an actuator having an output link for applying a mechanically vertical driving force in response to the electric trip operation control signal from the overcurrent trip relay, a first link unit connected between the output link of the actuator and the switching mechanism to transmit the mechanical driving force from the output link to the switching mechanism in response to the trip operation control signal such that the switching mechanism can be tripped, and a main cover provided with a manipulating unit which a user manipulates, the air circuit breaker comprising:

a second link unit vertically movable;

a first rotation lever connected to the first link unit and contactable with the second link unit so as to allow or restrict the vertical movement of the second link unit;

a driving spring for a trip indication connected to one end of the second link unit to apply an elastic biasing force to the second link unit such that it is moved in one direction;

a second rotation lever installed to be rotatable with being contacted with one end portion of the second link unit; and a mechanical trip indicating mechanism installed to be supported by the main cover, and having an indicating portion exposed to the outside of the main cover to indicate that the air circuit breaker is in a blocked state, and a driving force receiving portion contacted with the second rotation lever to receive a driving force to expose the indicating portion from the second rotation lever.

7. The air circuit breaker of claim 6, wherein the mechanical trip indicating mechanism comprises:

a trip indicating rod having an indicating portion exposed onto a plate of the front surface to indicate that the air circuit breaker is in a tripped state, and a driving force receiving portion extending from the indicating portion to be contacted with the second rotation lever and thereby receiving a horizontal driving force for exposing the indicating portion from the second rotation lever;

a guiding member fixed to a rear surface of the plate of the front surface to guide the movement of the trip indicating rod; and a first return spring configured to apply an elastic biasing force to the trip indicating rod in a direction opposite to the direction of the trip indicating rod being exposed to the plate of the front surface.

8. The air circuit breaker of claim 6, further comprising a restricting bias spring connected to the first rotation lever so as to apply an elastic biasing force to the first rotation lever to thereby be rotated in the direction of restricting the second link unit.

9. The air circuit breaker of claim 6, wherein the actuator comprises at least one stopper fixed to a side wall of the actuator to limit vertically moved distance of the second link unit, wherein the second link unit comprises long hole portion limitedly moved in the vertical direction by the at least one stopper, and a driving force transmitting lever portion contacted with the second rotation lever for providing a rotation driving force to the second rotation lever.

10. The air circuit breaker of claim 6, further comprising a second return spring configured to return the second rotation lever to an initial position thereof when a mechanical trigger signal is not outputted from the output link of the actuator.

* * * * *